US010683111B2

(12) United States Patent
Ehrmann et al.

(10) Patent No.: US 10,683,111 B2
(45) Date of Patent: Jun. 16, 2020

(54) THERMO-FORMING PACKAGING MACHINE

(71) Applicant: MULTIVAC Sepp Haggenmüller SE & Co. KG, Wolfertschwenden (DE)

(72) Inventors: Elmar Ehrmann, Bad Grönenbach (DE); Michael Lang, Buching (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 202 days.

(21) Appl. No.: 15/795,161

(22) Filed: Oct. 26, 2017

(65) Prior Publication Data

US 2018/0118381 A1 May 3, 2018

(30) Foreign Application Priority Data

Oct. 28, 2016 (EP) ..... 16196156

(51) Int. Cl.

| | |
|---|---|
| ***B65B 7/16*** | (2006.01) |
| ***B65B 61/28*** | (2006.01) |
| ***B65B 9/04*** | (2006.01) |
| ***B65B 61/06*** | (2006.01) |
| ***B65B 35/24*** | (2006.01) |
| ***B65B 41/12*** | (2006.01) |
| ***B65B 65/00*** | (2006.01) |

(52) U.S. Cl.

CPC ..... *B65B 7/164* (2013.01); *B65B 9/04* (2013.01); *B65B 9/045* (2013.01); *B65B 35/24* (2013.01); *B65B 41/12* (2013.01); *B65B 61/06* (2013.01); *B65B 61/28* (2013.01); *B65B 65/003* (2013.01)

(58) Field of Classification Search

CPC ..... B65B 7/164; B65B 9/04; B65B 9/045; B65B 35/24; B65B 41/12; B65B 61/06; B65B 61/28; B65B 65/003

USPC ..... 53/559, 561, 329.2, 329.3, 329.5

See application file for complete search history.

(56) References Cited

U.S. PATENT DOCUMENTS 3,303,628 A * 2/1967 Lovas et al. ..... B65B 9/04 53/433

3,766,702 A * 10/1973 Meissner et al. ..... B65B 9/042 53/453

(Continued)

FOREIGN PATENT DOCUMENTS

CA 2498654 A1 * 4/2004 ..... B65B 9/04

CN 1146755 A 4/1997

(Continued)

*Primary Examiner* — Stephen F. Gerrity

(74) *Attorney, Agent, or Firm* — Brooks Kushman P.C.

(57) ABSTRACT

A thermo-forming packaging machine having a transport device that is configured to convey a lower film in a film transport surface along a transport direction from a forming station for forming troughs in the lower film through an inserting track for filling the troughs with products to a sealing station for sealing the troughs with an upper film and further to a cutting station for separating the closed troughs. In one embodiment, the film transport surface comprises a first ascending area and a first descending area that is arranged downstream of the ascending area between the forming station and the sealing station. Alternatively or in addition, the film transport surface comprises between the sealing station and the cutting station a second ascending area and after the cutting station a second descending area.

20 Claims, 2 Drawing Sheets

(56) References Cited

U.S. PATENT DOCUMENTS

| | | | | | |
|---|---|---|---|---|---|
| 4,034,536 | A * | 7/1977 | Mahaffy et al. | B65B 9/04 | 53/433 |
| 4,366,663 | A * | 1/1983 | Grebe | B65B 31/021 | 425/121 |
| 4,571,924 | A * | 2/1986 | Bahrani | B65B 9/042 | 53/453 |
| 5,081,816 | A * | 1/1992 | Cardinali | B65B 35/52 | 53/157 |
| 5,155,981 | A * | 10/1992 | Tordini | B65B 35/18 | 198/468.4 |
| 6,701,695 | B1 | 3/2004 | Douglas | | |
| 7,392,631 | B2 * | 7/2008 | Conti | B65B 7/164 | 226/30 |
| 8,820,037 | B2 * | 9/2014 | Ehrnnann | B65B 35/24 | 53/251 |
| 2013/0319818 | A1 * | 12/2013 | Worz | B65B 35/24 | 198/426 |
| 2014/0260123 | A1 * | 9/2014 | Drechsler et al. | B65B 35/24 | 53/559 |
| 2015/0203226 | A1 * | 7/2015 | Baroncini | B65B 9/045 | 221/1 |

FOREIGN PATENT DOCUMENTS

| | | | | | |
|---|---|---|---|---|---|
| CN | 104703881 | A | 6/2015 | | |
| CN | 104787371 | A | 7/2015 | | |
| CN | 204822232 | U | 12/2015 | | |
| CN | 108016644 | A | 5/2018 | | |
| DE | 1809656 | A1 * | 6/1970 | B65B 9/045 | |
| DE | 3020633 | A1 | 12/1981 | | |
| DE | 3118946 | A1 | 12/1982 | | |
| DE | 20006336 | U1 | 8/2000 | | |
| DE | 10343483 | A1 | 4/2005 | | |
| DE | 102014106400 | A1 | 11/2015 | | |
| DE | 202016000757 | U1 | 4/2016 | | |
| DE | 102014119351 | A1 | 6/2016 | | |
| DE | 102015105175 | A1 | 10/2016 | | |
| EP | 1816075 | A1 | 8/2007 | | |
| EP | 2412632 | A1 | 2/2012 | | |
| EP | 2740677 | A1 | 6/2014 | | |
| EP | 2778079 | A1 | 9/2014 | | |
| EP | 3028774 | A1 | 6/2016 | | |
| FR | 1387203 | A | 1/1965 | | |
| FR | 2003547 | A1 * | 11/1969 | B65B 9/045 | |
| WO | 2007137165 | A2 | 11/2007 | | |
| WO | 2014013310 | A1 | 1/2014 | | |
| WO | 2014180823 | A1 | 11/2014 | | |

* cited by examiner

THERMO-FORMING PACKAGING MACHINE

CROSS-REFERENCE TO RELATED APPLICATIONS

This Application claims priority to European Patent Application No. 16 196 156.0, filed on Oct. 28, 2016, to Elmar Ehrmann and Michael Lang, currently pending, the entire disclosure of which is incorporated herein by reference.

FIELD OF THE INVENTION

The invention relates to the field of packaging machines. In particular, the invention relates to a thermo-forming packaging machine that can be configured for packaging of foodstuff products.

BACKGROUND OF THE INVENTION

In known thermo-forming packaging machines, troughs are formed in a lower film web using a forming station. In an inserting track, the troughs are filled with products to be packaged. In a sealing station, the filled troughs are sealed with an upper film. In this process, the packages that are being formed can in particular be evacuated and/or filled with protective gas in order to increase the durability of the packaged products. At a cutting station, the troughs in the lower film web that were filled and closed are separated from one another to obtain individual packages or connected groups of packages. During the packaging process, the lower film web is conveyed along a transport direction using a transport device. The forming station, the inserting track, the sealing station and the cutting station are arranged along the transport direction, for logical reasons in the mentioned order. The forming station, the sealing station and the cutting station can be disposed on a machine rack of the thermo-forming packaging machine. It is known to guide the products to be packaged using one or multiple feeding belts laterally towards the thermo-forming packaging machine in the area of the inserting track, where the products are put into the troughs of the lower film web using a picker or manually. As the distance between the feeding belt and the troughs to be filled has to be overcome each time during transfer of the products from the feeding belt into the troughs, the clocking or cycle time depends inter alia on this distance. The minimum distance that can be achieved between the feeding belt and the lower film web with the troughs formed in said lower film web is limited inter alia by the space requirement of the machine rack and the side claddings on both sides of the thermo-forming packaging machine.

A thermo-forming packaging machine according to a specialized structural form is known from the EP 2 778 079 A1. It comprises a side profile on whose inner side a chain guide for a film clamping chain for transporting the lower film web is disposed. The side profile, which is disposed along the inserting track, is at the same time a part of the product feeder for conveying the products to be packaged to the inserting track. According to this specialized structural form, the product feeding device is formed integrally with the side profile of the thermo-forming packaging machine in order to reduce the distance between the fed products and the troughs to be filled and hence to reduce the ways to be traversed for placement of the products into the troughs. The integration of the product feeder into the side profile of the thermo-forming packaging machine comes with the disadvantage that the thermo-forming packaging machine cannot simply be combined with different product feeding systems depending on the conditions of use. In addition, it is hard to adapt a packaging machine specialized this way to spatial conditions of the location of use.

A different way of feeding products to be packaged to an inserting track of a thermo-forming packaging machine is known from the DE 20 2016 000 757 U1. The thermo-forming packaging machine disclosed therein comprises clamping chains, which are held in chain guides, for holding and transporting the lower film on both sides along the transport direction. The chain guides are oriented horizontally along the forming station and along the sealing station. Along an inserting track that is located between the forming station and the sealing station, the chain guides have an ascending orientation. The chain guides are preferably inclined along the inserting track at an angle of 10° to 30° in relation to the horizontal line. In the obliquely extending inserting track, products to be packaged are inserted directly into the troughs of the lower film via a product inserting belt that extends above the film transport plane in parallel to the transport direction and that is formed as a retraction belt. Both the forming station as well as the sealing station are arranged on a machine rack of the thermo-forming packaging machine. The machine rack is elevated in the area of the sealing station. This ensures that, in spite of the rise of the chain guides between the forming station and the sealing station, the lower film with the formed troughs is fed to the sealing station at a level that is suitable for processing. Hence, the packaging machine requires a specifically adapted machine rack. As the product inserting belt for direct inserting of the products into the troughs extends in parallel to the transport direction above the film transport plane, attention has to be paid during construction of the thermo-forming packaging machine that movable upper parts of the forming station do not come in conflict with the product inserting belt during operation. Direct inserting of products into troughs, which are guided along an ascending area, using a retraction belt can be inappropriate for specific products and trough forms and requires accurate coordination of the operation of the individual components of the packaging machine.

Thermo-forming packaging machines that have complete cutting stations in order to separate multiple packages from a film composite are known from DE 30 20 633 A1 and DE 31 18 946 A1. The cut packages remain on support elements and are transported out of the complete cutting station onto a transport belt, which transports the packages out of the thermo-forming packaging machine and/or further, using drawing forward the remaining film grid. This comes with the disadvantage that the packages are fed uncontrollably to a subsequent working process on the transport belt. In addition and due to the transport belt that follows the complete cutting station, the overall length of the arrangement can become relatively large so that the arrangement cannot be used in narrow spaces.

SUMMARY OF THE INVENTION

The purpose of the invention is to provide a thermo-forming packaging machine that has a simple form and that enables efficient feeding of products to be packaged and/or efficient extraction of filled and closed packages.

A thermo-forming packaging machine according to the invention comprises a forming station, an inserting track, a sealing station and a cutting station. A transport device of the thermo-forming packaging machine may be configured to convey a lower film in a film transport surface along a transport direction from the forming station via the inserting track to the sealing station and further to the cutting station. The forming station comprises a forming tool for forming troughs in the lower film, in particular using thermo-forming the lower film. In the inserting track, which follows the forming station along the transport direction, the troughs formed in the lower film are filled with products to be packaged, in particular with foodstuffs. This can occur for example via a robot system such as a picker or also manually. The sealing station comprises a sealing tool for sealing the troughs with an upper film. Sealing can occur in a protective gas atmosphere or under vacuum in order to ensure maximum durability of the packaged products. For closing the troughs, the upper film can for example be sealed to the lower film in the sealing station using pressure and heat and/or through ultrasound welding. The cutting station that may be arranged downstream of the sealing station in the transport direction may be configured for separation, in particular automated separation, of the closed troughs so that the packaged products are separated from the lower film composite. The cutting station can for example be formed as a complete cutting station.

The invention focuses in particular on improving the accessibility for feeding of products to be packaged and/or for removing finished packages. According to the underlying principle of the invention, this can be achieved in a mostly similar way with regard to feeding and extraction of elements (products to be packaged or readily packaged products) during the operation of the thermo-forming packaging machine.

In a thermo-forming packaging machine according to a variant of the invention, the film transport surface comprises between the forming station and the sealing station a first area that ascends along the transport direction. Downstream of this first ascending area with regard to the transport direction, the film transport surface comprises a first descending area between the forming station and the sealing station. The indications "ascending" and "descending" can be understood in the sense of the invention in comparison to a horizontal plane. Thus, an "ascending" area of the film transport surface is to be understood as an area in which a vertical height of the film transport surface increases when progressing along the transport direction. A "descending" area is an area throughout which the vertical height of the film transport surface decreases when progressing along the transport direction.

With the rise of the film transport surface in the first ascending area it can be achieved that the film transport surface may be elevated in relation to a side frame of a machine rack of the thermo-forming packaging machine that can for example carry the forming station and the sealing station. This improves the accessibility of the film transport surface for the placement of the products to be packaged into the troughs formed in the lower film because the side frame of the machine rack is no longer or at least less in the way. As the first descending area may be arranged downstream of the first ascending area along the transport direction, there can be a hill-like elevation of the film transport surface. In the area of the hill-like elevation, the film transport surface may be particularly well accessible, both laterally as well as from the front and the rear (in relation to the transport direction). Therefore, the placement of products to be packaged into the troughs of the lower film may be facilitated. In particular, products to be packaged can be put into the troughs of the lower film in the fully well-accessible elevated area from multiple sides, in particular at the same time. Through the descending area, the film transport surface can be brought back to the same height level on which it was positioned ahead of the ascending area. The forming station and the sealing station can then be located in a common horizontal plane in which the lower film may be fed to them. It is not required to elevate the machine rack for example in the area of the sealing station in order to balance the elevation of the lower film in the first ascending area.

Alternatively (as a further variant of the invention) or in addition to the first ascending area and the first descending area of the film transport surface, the thermo-forming packaging machine can be formed in a way that the film transport surface comprises a second area that ascends along the transport direction between the sealing station and the cutting station and a second descending area after the cutting station in relation to the transport direction.

With the rise of the film transport surface through the second ascending area, the film transport surface can be elevated at the cutting station in relation to a side frame of a machine rack of the thermo-forming packaging machine so that the side frame does not hamper any access in the area of the cutting station. Through the second ascending area and the second descending area, there can be a hill-like elevation of the film transport surface in the area of the cutting station that allows for a particular good access in the area of the cutting station both laterally as well as from the front and the rear (in relation to the transport direction). Therefore, the filled, closed and separated packages can be extracted from the thermo-forming packaging machine and/or processed in a particularly efficient way.

A packaging machine according to the invention can have both the first ascending area and the first descending area as well as the second ascending area and the second descending area. However, it also may be conceivable that only the first ascending area and the first descending area are provided and that the extraction area for the filled and closed packages may be implemented at least partially in a different way. It would also be possible that only the second ascending area and the second descending area are provided and that the feeding area for the products to be packaged may be implemented at least partially in a different way.

Both with regard to the described measures for making the feeding area for products to be packaged accessible as well as with regard to the described measures for making the extraction area for the packages accessible, the local accessibility of the film transport plane may be improved using a hill-like elevation that may be formed by an ascending area and a descending area of the film transport surface.

The forming station and the sealing station can be disposed in a joint horizontal plane. This can mean that the lower film may be fed to the forming station and to the sealing station in a common horizontal plane. This way, the forming station and the sealing station can for example be both arranged on a machine rack that may be formed in a simple manner.

After the second descending area with regard to the film transport direction, a packaging discharge device that conveys in parallel to the transport direction for leading away filled and closed packages can be provided. With the second descending area, the film transport surface can be set to the same level as the packaging discharge device that conveys in parallel to the transport direction. In particular and due to the second descending area, the packaging discharge device that conveys in parallel to the transport direction can be arranged essentially at a level that corresponds to the level of the film transport surface ahead of the second ascending area. Hence, the packaging discharge device that conveys in parallel to the transport direction does not have to be elevated due to the second ascending area of the film transport surface.

The film transport surface preferably comprises a first even area between the first ascending area and the first descending area. The first even area can comprise the inserting track for filling the troughs in the lower film with products. Advantageously, the first even area may be directly adjacent to the first ascending area along the transport direction and the first descending area may be directly adjacent to the first even area.

In a similar way, a second even area of the film transport surface can be provided between the second ascending area and the second descending area in the area of the cutting device. The second even area may be preferably directly adjacent to the second ascending area along the transport direction and the second descending area may be directly adjacent to the second even area.

The first and/or second even area of the film transport surface, which may be enclosed by respectively one ascending and one descending area, can be elevated in a hill-like way and therefore be particularly well accessible from all sides. Due to this, the placement of the products to be packaged into the troughs of the lower film (first even area) and/or the extraction of the finished packages (second even area) can be simplified.

The thermo-forming packaging machine can comprise a machine rack with a side frame that has an upper interfering edge. The film transport surface can be guided through the first ascending area and/or the second ascending area to a level that may be located above the interfering edge of the side frame. It can therefore be achieved that following the first ascending area and/or the second ascending area the film transport surface may be located at a higher level than the interfering edge of the side frame and hence that the accessibility of the film transport surface may be further increased in the relevant areas.

Ahead of the first ascending area and/or after the first descending area with regard to the transport direction, the film transport surface can be located below the interfering edge of the side frame. Therefore, the lower film may be provided in a protected way within the side frame. In particular, movable elements of the transport device for moving the lower film along the transport direction are protected against unintended access through the side frame.

For feeding products to be packaged, a first and/or a second product feeding device can be provided. It would be conceivable that the first and/or the second product feeding device conveys the products in parallel to the transport direction. Due to the first ascending area of the film transport surface, such product feeding devices could be moved particularly closely to the film transport surface, in particular above the side frame of the machine rack in the area of the inserting track, so that the products could be placed into the troughs in the lower film in a particularly efficient way. For certain applications, by contrast, it may be particularly advantageous when the first and/or the second product feeding device conveys the products transversally to the transport direction and extends at least in certain areas above the film transport surface. In particular, the first and/or the second product feeding device can cross the film transport surface transversally to the transport direction. Product feeding devices that convey transversally to the transport direction have the advantage as compared to product feeding devices that convey longitudinally to the transport direction that a plurality of products can be processed at the same time along the overall transversal extension of the lower film, for example using a suitable gripping device. In case of manual placement from the product feeding devices into the troughs of the lower film, product feeding devices that convey transversally have the advantage that they do not hamper the access to the inserting track by an operating person standing laterally next to the thermo-forming packaging machine.

The first ascending and the first descending area of the film transport surface allow transversally conveying product feeding devices to be moved particularly closely to the film transport plane in the area of the inserting track. For example, the first product feeding device can cross the film transport surface in the area of the first ascending area and the second product feeding device can cross the film transport surface in the area of the first descending area. The first product feeding device can cross the film transport surface ahead of the first even area in relation to the transport direction and be located for example less than 5 cm or less than 10 cm away from the first even area in the direction of the transport direction. The second product feeding device can cross the film transport surface following the first even area and be located for example at a distance of less than 5 cm or less than 10 cm from the first even area along the transport direction. Transport surfaces of the first and/or second product feeding device for receiving the products to be packaged can be located at least essentially at the same level as the film transport surface between the first ascending area and the first descending area. In particular, the transport surfaces can be located at least essentially at the same level as the first even area. A vertical height difference between the transport surfaces of the first and/or the second product feeding device and the film transport surface in the first even area can be for example less than 1 cm, less than 2 cm, less than 3 cm or less than 5 cm. Therefore, the path to be traveled during placement of the products into the troughs can be minimized further.

The product feeding devices can each be designed as a product feeding belt. But it is also possible that the product feeding devices are formed differently. For example, the product feeding devices can be formed as a shuttle arrangement for feeding of products. Exemplary shuttle arrangements are known from DE 10 2014 119 351 A1 and DE 10 2014 106 400 A1. Such shuttle arrangements comprise a track system and transport shuttles installed in said track system movably along a conveying direction with a surface for receiving products to be transported. The transport shuttles can be moved through the track system for example using changing magnetic fields that are created by the track system.

In addition or as an alternative to the packaging discharge device described above that conveys in parallel to the transport direction, a first and/or a second packaging discharge device for leading away filled and sealed packages can be provided, which conveys transversally to the transport direction and which respectively extends at least in certain areas above the film transport surface. Packages that have been filled, sealed and separated by the cutting station can be put onto the transversally conveying packaging discharge devices individually or in groups, manually or automatically. For example, the packages can be put onto the transversally conveying packaging discharge devices using one or multiple grippers. The first and/or the second packaging discharge device that conveys transversally to the transport direction can cross the film transport surface. Packages can be placed onto the transversally conveying packaging discharge device, preferably throughout the overall width of the film transport surface, at the same time.

The packaging discharge devices can be designed as packaging discharge belts. But it is also possible that the packaging discharge devices are formed differently, for example as shuttle arrangements for leading away packages.

The transport device for the lower film can have a chain guide that may be arranged along the transport direction and in which at least one film transport chain for conveying the lower film is guided. In particular, the chain guide can have guiding elements for guiding film transport chains that are arranged on both sides along the transport direction. An exemplary chain guide may be known from the EP 1 816 075 A1. Using a suitable design of the chain guide, the desired course of the film transport surface, in particular the first ascending area and the first descending area and/or the second ascending area and the second descending area, can be implemented in a structurally simple way.

The chain guide may be preferably fastened on the side frame. Particularly preferably, the chain guide may be located on the inside in relation to the side frame. Therefore, the chain guide may be integrated compactly in the thermo-forming packaging machine and may be at least partially imperceptible towards the outside. In addition, unintended access, which could lead to injuries, is prevented.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
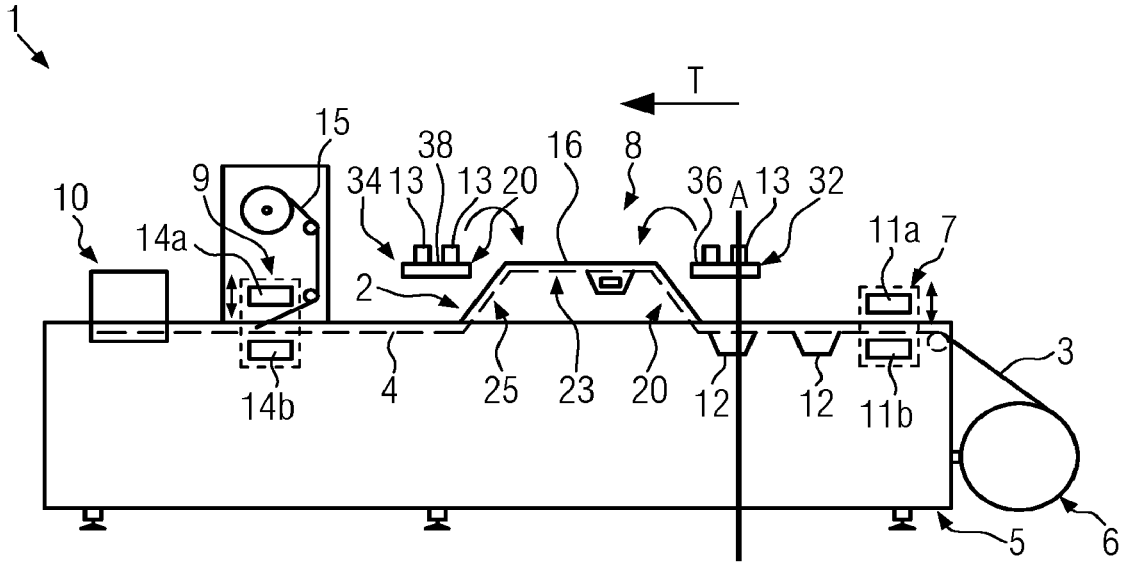
FIG. 1 is a schematic side view of one embodiment of a thermo-forming packaging machine in accordance with the teachings of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic side view of a thermo-forming packaging machine 1 according to an embodiment of the invention. The thermo-forming packaging machine 1 comprises a transport device 2 that is designed to convey a lower film 3 in a film transport surface 4 (areas of said film transport surface that are not visible in the side view are indicated with dashed lines) along a transport direction T. The lower film 3 can be extracted from a supply roll 6 installed on a machine rack 5 of the thermo-forming packaging machine 1. Along the transport direction T, a forming station 7, an inserting track 8, a sealing station 9 and a cutting station 10 are provided in the mentioned order. During the operation of the thermo-forming packaging machine 1, troughs 12 are formed in the lower film 3 by the forming station 7 using a forming tool, in particular using thermo-forming. For this purpose, the forming tool can comprise a forming tool upper part 11*a* and a forming tool lower part 11*b*. Along the inserting track 8, the troughs 12 are filled with products 13 to be packaged. The sealing station 9 comprises a sealing tool for sealing the troughs 12 with an upper film 15. The sealing tool can comprise a sealing tool upper part 14*a* and a sealing tool lower part 14*b*. The sealing tool and/or a part of it can be movable in a direction perpendicular to the transport direction T and be designed to seal the lower film 3 and the upper film 15 along appropriate welding seams using pressure and heat. The sealing station 9 can be designed to perform the sealing process in a protective gas atmosphere or under vacuum in order to increase the durability of the packaged products 13. The cutting station 10 that is arranged downstream of the sealing station 9 along the transport direction T is configured to separate the packages, which were formed by the troughs 12 that had been filled and sealed with the upper film 15, from one another. In particular, the cutting station 10 can be a complete cutting station.

In the displayed embodiments, the transport device 2 for conveying the lower film 3 comprises chain guides 16 that are arranged on both sides along the transport direction T and in which respectively one or multiple film transport chains 17 for conveying the lower film 3 are guided. The course of the film transport surface 4 can be determined through appropriate design of the chain guides 16. Preferably, the chain guides 16 arranged on both sides extend essentially in parallel to one another so that the film transport surface 4 has essentially no inclination in relation to a transversal direction of the thermo-forming packaging machine 1.

In the embodiment from FIG. 1, the lower film 3 is guided in such a way that the film transport surface 4 comprises a first ascending area 20 ascending along the transport direction T between the forming station 7 and the sealing station 9. In the course of the first ascending area 20, the vertical height of the film transport surface 4 increases along the transport direction T of the lower film 3. The vertical height of the film transport surface 4 can increase strictly monotonously or monotonously in the ascending area 20. But it is also conceivable that the vertical height of the film transport surface 4 decreases intermittently during the course of the ascending area 20, as long as the vertical height of the film transport surface 4 is lower at the beginning of the ascending area 20 in relation to the transport direction T than at the end of the ascending area 20. For example, the vertical height of the film transport surface 4 can increase throughout the first ascending area 20 by at least 5 cm, at least 10 cm or at least 15 cm. The first ascending area 20 is followed by a first even area 23 in which the film transport surface 4 extends at least essentially in a horizontal way. The first even area 23 comprises the inserting track 8 for filling the troughs 12 with the products 13 to be packaged. The film transport surface 4 comprises a first descending area 25 that follows the first even area 23 in relation to the transport direction T and that descends along the transport direction T.

In the displayed case, the height of the transport surface 4 decreases throughout the first descending area 25 by the same value by which it has increased in the course of the first ascending area 20. It can therefore be achieved that the film transport surface 4 in the area of the sealing station 9 that is disposed downstream of the first descending area 25 is arranged at least approximately on the same level as in the area of the forming station 7. Similar to the forming station 7, the sealing station 9 can simply be installed on the machine rack 5 and finds the lower film 3 at a level that is suitable for processing.

Figure 2:
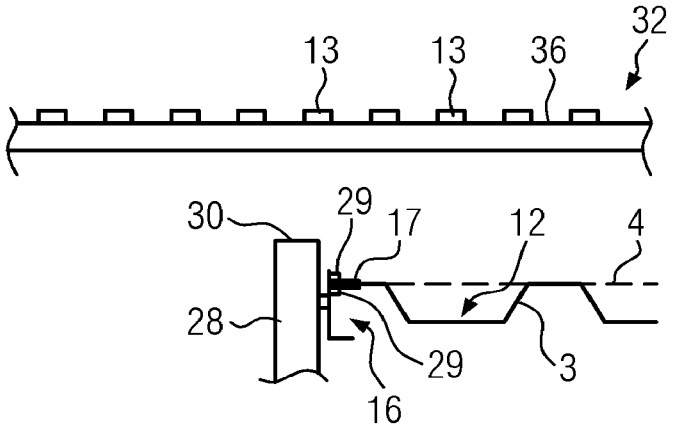
FIG. 2 is a schematic sectional section view of a portion of the thermo-forming packaging machine of FIG. 1 cut along the line A.

FIG. 2 shows a sectional section view through the thermo-forming packaging machine 1 displayed in FIG. 1, wherein the situation of the section plane is marked by the line A in FIG. 1 and wherein the section plane is perpendicular to the transport direction T. In the shown embodiment, the chain guide 16, in which the film transport chain 17 for conveying the lower film 3 is guided, is installed in an inner side of a side frame 28 of the machine rack 5 of the thermo-forming packaging machine 1. In the displayed embodiment, the chain guide 16 comprises an element that is L-shaped in section and at which guiding rails 29, between which the film transport chain 17 is guided, are provided.

FIG. 2 illustrates the situation at a position that is disposed ahead of the first ascending area 20 of the film transport surface 4 in relation to the transport direction T. Here, in the displayed embodiments, the film transport surface 4 is disposed below an interfering edge 30 of the side frame 28. But this is not absolutely necessary. The film transport surface 4 could also be at the same level as the interfering edge 30 of the side frame 28 or be disposed slightly above said interfering edge 30. It is advantageous for the film transport surface 4 to be disposed slightly below the interfering edge 30 or approximately at the same level as the interfering edge 30 as this enables optimal processing of the lower film 3 by the forming station 7 that is carried by the machine rack 5 without the operation of the forming station 7 being impaired by the machine rack 5.

Compared to the illustration from FIG. 2 (area ahead of the first ascending area 20 of the film transport surface 4), the film transport surface 4 is, as becomes evident from FIG. 1, provided at a higher position in the first even area 23 of the film transport surface 4. In particular, the film transport surface 4 is located at a higher level than the interfering edge 30 of the side frame 28 in the first even area 23. This can be achieved using prolonging the L-shaped element of the chain guide 16 in an upward direction.

To put the products 13 to be packaged into the inserting track 8, product feeding devices 32, 34, which are formed as product feeding belts in the shown embodiment, are provided. Due to the hill-like elevation of the film transport surface 4 that is formed by the first ascending area 20, the first even area 23 and the first descending area 25, the film transport surface 4 is elevated in the area of the inserting track 8 in relation to the interfering edge 30 of the side frame 28. Therefore, the product feeding devices 32, 34 can be positioned in particularly close proximity to the lower film 4 in the area of the inserting track 8. The products 13 to be packaged can be put automatically or manually from the product feeding devices 32, 34 into the troughs 12 of the lower film 4, for example using grippers. In the shown embodiment, the product feeding devices 32, 34 convey transversally to the transport direction T and extend over the film transport surface 4 in specific areas. A first product feeding device 32 crosses the film transport surface 4 in relation to the transport direction T ahead of the first even area 23. In particular, the first product feeding device 32 crosses the film transport surface 4 in the area of the first ascending area 20 of the film transport surface 4. A second product feeding device 34 crosses the film transport plane 4 in relation to the transport direction T after the first even area 23 of the film transport surface 4. In particular, the second product feeding device 34 crosses the film transport surface 4 in the area of the first descending area 25 of the film transport surface 4.

In FIG. 1, the product feeding devices 32, 34 convey into the drawing plane or out of it. Evidently, the first ascending area 20 and the first descending area 25 allow, both horizontally as well as vertically, the product feeding devices 32, 34 to be moved particularly closely to the film transport surface 4 in the area of the inserting track 8. Hence, the products 13 can be put from the product feeding devices 32, 34 into the troughs 12 of the lower film 3 on a particularly short path and therefore in an efficient manner. For example, the product feeding devices 32, 34 can each be less than 5 cm or less than 10 cm away from the first even area 23 of the film transport surface 4 in relation to the transport direction T. Transport surfaces 36, 38 of the first and/or the second product feeding device 32, 34 for receiving the products 13 to be packaged can be at least essentially on the same level as the film transport plane 4 in the first even area 23. A vertical height difference between the transport surfaces 36, 38 and the first even area 23 of the film transport surface 4 can for example be less than 1 cm, less than 2 cm, less than 3 cm or less than 5 cm.

A first and a second product feeding device 32, 34 are provided in the displayed embodiment. Products 13 can be put into the troughs 12 from both product feeding devices 32, 34 at the same time. But it would also be conceivable to provide only one of the two product feeding devices 32, 34.

After passing the sealing station 9, the lower film 3 with the troughs 12 that have been filled and closed with the upper film 15 formed therein is fed to the cutting station 10 where the filled and closed troughs 12 are separated. Subsequently, the separated, packaged product can be removed from the thermo-forming packaging machine 1. This can occur in different ways that are not shown in detail in FIG. 1. Removal of the packaging could occur for example in a simple way using manual removal after separation by the cutting station 10. It is also conceivable to transport the packages further via discharge devices, in particular discharge belts. For this purpose, the packages can be put or dropped manually or automatically onto one or multiple discharge devices.

Figure 3:
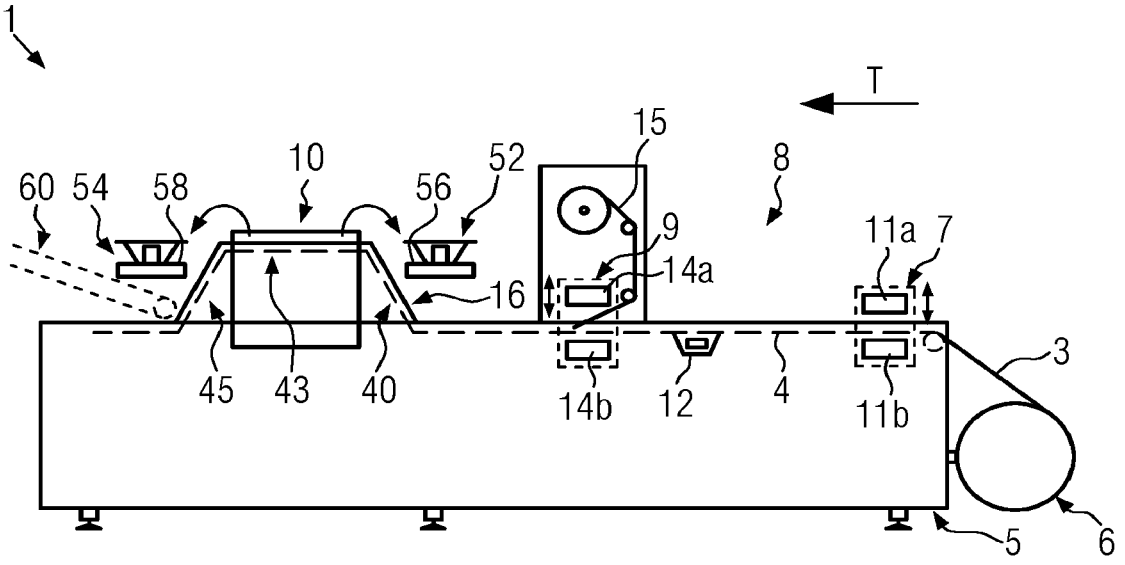
FIG. 3 is a schematic side view of an embodiment of a thermo-forming packaging machine in accordance with the teachings of the present invention.

FIG. 3 shows a schematic side view of a thermo-forming packaging machine 1 according to an embodiment that allows for a particularly good access to the film transport plane 4 in the area of the cutting station 10. Also in this embodiment, the thermo-forming packaging machine 1 comprises a transport device 2 that is designed to convey the lower film 3 in a film transport surface 4 along the transport direction T. Also here, the lower film 3 passes along the transport direction T through the forming station 7, the inserting track 8, the sealing station 9 and the cutting station 10 in the mentioned order. The forming station 7, the sealing station 9 and the cutting station 10 can be formed as in the embodiment from FIG. 1. In the display shown in FIG. 3, the film transport surface 4 extends from the forming station 7 via the inserting track 8 up to the sealing station 9 in a horizontal plane. But this is not necessary. No details regarding feeding of the products 13 to the inserting track 8 or regarding the placement of the products 13 into the troughs 12 formed by the forming station 7 in the lower film 3 are specified further. For example, the products 13 could be put into the troughs 12 manually or automatically, in particular using a picker.

Similar to the embodiments of FIGS. 1 and 2, the transport device 2 for conveying the lower film 3 can comprise chain guides 16 that are disposed on both sides along the transport direction T and on which respectively one or multiple film transport chains 17 for conveying the lower film 3 are guided. According to the embodiment from FIG. 3, the film transport surface 4 following the sealing station 9 in relation to the transport direction T has a specific course that enables good access to the film transport plane 4 in the area of the cutting station 10 and hence a fast and efficient removal of readily packaged products 13.

The lower film 3 is guided in such a way that the film transport surface 4 comprises a second ascending area 40 along the transport direction T between the sealing station 9 and the cutting station 10. In the course of the second ascending area 40, the vertical height of the film transport surface 4 increases along the transport direction T. For example, the vertical height of the film transport surface 4 can increase throughout the second ascending area 40 by at least 5 cm, at least 10 cm or at least 15 cm. A second even area 43, in which the film transport surface 4 extends at least essentially in a horizontal manner, is adjacent to the second ascending area 40. The second even area 43 is located in the area of the cutting station 10. The film transport surface 4 comprises a second descending area 45 that follows the second even area 43 in relation to the transport direction T, that descends along the transport direction T and that is arranged downstream of the cutting station 10 in relation to the transport direction T. In the displayed case, the height of the film transport surface 4 decreases throughout the second descending area 45 by the same value by which it has increased in the course of the second ascending area 40.

To convey the packages, which have been filled and separated by the cutting station 10, away from the thermo-forming packaging machine 1, packaging discharge devices 52, 54, which are formed as packaging conveying belts in the displayed embodiment, are formed.

Due to the hill-like elevation of the film transport surface 4 formed by the second ascending area 40, the second even area 43 and the second descending area 45, the film transport surface 4 is elevated in the area of the cutting station 10 in relation to the interfering edge 30 of the side frame 28. Therefore, the packaging discharge devices 52, 54 can be positioned in particularly close proximity to the lower film 4 in the area of the cutting station 10. The separated packages can be put from the thermo-forming packaging machine 1 onto the packaging discharge devices 52, 54 automatically or manually, for example using grippers. In the displayed embodiment, the packaging discharge devices 52, 54 convey transversally to the transport direction T and extend in certain areas above the film transport surface 4.

A first packaging discharge device 52 crosses the film transport surface 4 in relation to the transport direction T ahead of the second even area 43. In particular, the first packaging discharge device 52 crosses the film transport surface 4 in the area of the second ascending area 40 of the film transport surface 4. A second packaging discharge device 54 crosses the film transport surface 4 in relation to the transport direction T after the second even area 43 of the film transport surface 4. In particular, the second packaging discharge device 54 crosses the film transport surface 4 in the area of the second descending area 45 of the film transport surface 4.

In FIG. 3, the packaging discharge devices 52, 54 convey into the drawing plane or out of it. Evidently, the second ascending area 40 and the second descending area 45 allow the packaging discharge devices 52, 54 to be moved particularly closely to the film transport surface 4 in the area of the cutting station 10, both horizontally as well as vertically. Hence, the packages can be placed from the thermo-forming machine 1 onto the packaging discharge devices 52, 54 on a particularly short path and hence efficiently. For example, the packaging discharge devices 52, 54 can respectively be at a distance of less than 5 cm or less than 10 cm from the second even area 43 of the film transport surface 4 in relation to the transport direction T. Transport surfaces 56, 58 of the first and/or the second packaging discharge devices 52, 54 for the intake of the packages can be at least essentially on the same level as the film transport surface 4 in the second even area 43. A vertical height difference between the transport surfaces 56, 58 and the second even area 43 of the film transport surface 4 can for example be less than 1 cm, less than 2 cm, less than 3 cm or less than 5 cm.

In the displayed embodiment, a first and a second packaging discharge device 52, 54 are provided. Preferably, packages can be placed simultaneously onto both packaging discharge devices 52, 54. But it would also be conceivable to provide only one of the two packaging discharge devices 52, 54.

Instead of the described packaging discharge devices 52, 54 that convey transversally to the transport direction T, or in addition, also a packaging discharge device 60 that conveys in parallel to the transport direction T, which is arranged downstream of the second descending area 45 of the film transport surface 4 in relation to the transport direction T, can be provided. Such a packaging discharge device 60 that conveys in parallel to the transport direction T is indicated exemplarily with dashed lines in FIG. 3. Packages separated from the cutting station 10 can be put onto the packaging discharge device 60, which conveys in parallel to the transport direction T, manually or automatically. It would also be possible for the packaging discharge device 60, which conveys in parallel to the transport direction T, to be arranged in a way that the separated packages fall by themselves onto the packaging discharge device 60 that conveys in parallel to the transport direction T.

A thermo-forming packaging machine 1, which allows for a particularly good access to the film transport surface 4 in the area of the inserting track 8, was described with reference to FIG. 1. As described, the film transport surface 4 comprises for this purpose the first ascending area 20 and the first descending area 25. Following the sealing station 9, the course of the film transport surface 4 can in principle be designed in any way. After separation of the packages by the cutting station 10, the readily packaged products 13 can be extracted from the thermo-forming packaging machine 1 in any way. For example, the packaged products 13 can be extracted manually or automatically.

A thermo-forming packaging machine 1, which allows for a particularly good access to the film transport surface 4 in the area of the cutting station 10, was described with reference to FIG. 3. For this purpose, the second ascending area 40 is provided between the sealing station 9 and the cutting station 10 and the second descending area 45 of the film transport surface 4 is provided following the cutting station 10. In relation to the transport direction T ahead of the sealing station 9, the course of the film transport surface 4 can in principle be chosen in any way. Also the way of feeding packaged products 13 as well as placement of the products 13 to be packaged into the troughs 12 of the lower film 3 can be designed in any way. For example, the products 13 can be put into the troughs 12 manually or automatically.

It is therefore conceivable that, according to the invention, either only the first ascending area 20 and the first descending area 25 are provided and that the access in the area of the cutting station 10 occurs in any way. Likewise, it is conceivable that only the second ascending area 40 and the second descending area 45 are provided and that the access in the area of the inserting track 8 occurs in any way.

According to a particularly preferable embodiment of a thermo-forming packaging machine 1, however, the special course of the film transport surface 4 between the forming station 7 and the sealing station 9 is provided in a combined way with the first ascending area 20 and the first descending area 25 (FIG. 1), and so is at the same time the special course of the film transport surface 4 following the sealing station 9 with the second ascending area 40 and the second descending area 45. According to such an embodiment, the course of the film transport surface 4 in the area between the forming station 7 and the sealing station 9 could for example correspond to the course shown in FIG. 1. Following the sealing station 9, the course of the film transport surface 4 could be for example as illustrated in FIG. 3.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermo-forming packaging machine comprising:

a machine rack having a side frame that has an upper interfering edge:

a forming station with a forming tool for the formation of one or more troughs in a lower film;

an inserting track for filling the troughs with products;

a sealing station with a sealing tool for closing the troughs with an upper film;

a cutting station for separating the closed troughs into one or more packages; and a transport device that is designed to convey the lower film in a film transport surface along a transport direction from the forming station through the inserting track to the sealing station and further to the cutting station, wherein the film transport surface comprises between the forming station and the sealing station a first ascending area ascending along the transport direction and comprises between the forming station and the sealing station a first descending area descending along the transport direction and arranged downstream of the first ascending area in the transport direction, wherein the film trans ort surface is guided through the first ascending area onto a level that is located above the interfering edge of the side frame.

2. The thermo-forming packaging machine according to claim 1, wherein the film transport surface comprises a second ascending area ascending along the transport direction between the sealing station and the cutting station and a second descending area downstream of the cutting station in the transport direction.

3. The thermo-forming packaging machine according to claim 2, further comprising a packaging discharge device for leading away the one or more packages downstream of the second descending area in the transport direction, wherein the packaging discharge device conveys in parallel to the transport direction.

4. The thermo-forming packaging machine according to claim 2, wherein the film transport surface has a second even area disposed between the second ascending area and the second descending area.

5. The thermo-forming packaging machine according to claim 1, wherein the forming station and the sealing station are disposed in a common horizontal plane.

6. The thermo-forming packaging machine according to claim 1, wherein the film transport surface has a first even area disposed proximate the inserting track and between the first ascending area and the first descending area.

7. The thermo-forming packaging machine according to claim 1, wherein the film transport surface is located below the interfering edge of the side frame in at least one location of upstream of the first ascending area in the transport direction, or downstream of the first descending area in the transport direction.

8. The thermo-forming packaging machine according to claim 1, further comprising a first product feeding device for feeding of products, where the first product feeding device conveys products in a direction transverse to the transport direction, and a portion of the first product feeding device extends over the film transport surface in at least one area.

9. The thermo-forming packaging machine according to claim 8, further comprising a second product feeding device for feeding of products, wherein the first product feeding device crosses the film transport surface in the area of the first ascending area and the second product feeding device crosses the film transport surface in the area of the first descending area.

10. The thermo-forming packaging machine according to claim 8, wherein a transport surface of first product feeding device is disposed substantially on the same level as the film transport surface between the first ascending area and the first descending area.

11. The thermo-forming packaging machine according to claim 1, wherein the transport device includes a chain guide that is disposed along the transport direction and that guides at least one film transport chain for conveying the lower film.

12. A thermo-forming packaging machine comprising:

a machine rack having a side frame that has an upper interfering edge;

a forming station with a forming tool for the formation of one or more troughs in a lower film;

an inserting track for filling the troughs with products;

a sealing station with a sealing tool for closing the troughs with an upper film;

a cutting station for separating the closed troughs into one or more packages; and a transport device that is designed to convey the lower film in a film transport surface along a transport direction from the forming station through the inserting track to the sealing station and further to the cutting station, wherein the film transport surface comprises an ascending area ascending along the transport direction between the sealing station and the cutting station and a descending area downstream of the cutting station in the transport direction, wherein the film transport surface is guided through the ascending area onto a level that is located above the interfering edge of the side frame.

13. The thermo-forming packaging machine according to claim 12, wherein the film transport surface has an even area disposed between the ascending area and the descending area.

14. The thermo-forming packaging machine according to claim 12, further comprising a first package discharge device for leading away filled and closed packages, wherein the first package discharge device conveys in a direction transverse to the transport direction and said first package discharge device extends over at least a portion of the film transport surface.

15. The thermo-forming packaging machine according to claim 14, wherein the first packaging discharge device crosses the film transport surface in the area of the ascending area.

16. The thermo-forming packaging machine according to claim 14 further comprising a second package discharge device that conveys in a direction transverse to the transport direction, and wherein the second package discharge device crosses the film transport surface in the area of the descending area.

17. The thermo-forming packaging machine according to claim 16, wherein a transport surface of at least one of the first packaging discharge device or the second packaging discharge device is disposed substantially on the same level as the film transport surface between the ascending area and the descending area.

18. A thermo-forming packaging machine comprising:

a forming station with a forming tool for the formation of one or more troughs in a lower film;

an inserting track for filling the troughs with products;

a sealing station with a sealing tool for closing the troughs with an upper film;

a cutting station for separating the closed troughs into one or more packages;

a transport device that is designed to convey the lower film in a film transport surface along a transport direction from the forming station through the inserting track to the sealing station and further to the cutting station; and a first product feeding device for feeding of products, wherein the film transport surface comprises between the forming station and the sealing station a first ascending area ascending along the transport direction and comprises between the forming station and the sealing station a first descending area descending along the transport direction and arranged downstream of the first ascending area in the transport direction; and wherein the first product feeding device conveys products in a direction transverse to the transport direction, and a portion of the first product feeding device extends over the film transport surface in at least one area.

19. The thermo-forming packaging machine according to claim 18, further comprising a second product feeding device for feeding of products, wherein the first product feeding device crosses the film transport surface in the area of the first ascending area and the second product feeding device crosses the film transport surface in the area of the first descending area.

20. The thermo-forming packaging machine according to claim 18, wherein a transport surface of the first product feeding device is disposed substantially on the same level as the film transport surface between the first ascending area and the first descending area.

* * * * *